US009688424B2

(12) United States Patent
Meyer et al.

(10) Patent No.: US 9,688,424 B2
(45) Date of Patent: Jun. 27, 2017

(54) FILLING SYSTEM FOR FILLING IN POWDER AND METHOD FOR FILLING IN POWDER

(71) Applicant: Harro Höfliger Verpackungsmaschinen GmbH, Allmersbach im Tal (DE)

(72) Inventors: Hermann Meyer, Weissach im Tal (DE); Andreas Thienst, Backnang (DE)

(73) Assignee: Harro Höfliger Verpackungsmaschinen GmbH, Allmersbach im Tal (DE)

( * ) Notice: Subject to any disclaimer, the term of this patent is extended or adjusted under 35 U.S.C. 154(b) by 189 days.

(21) Appl. No.: 14/099,930

(22) Filed: Dec. 7, 2013

(65) Prior Publication Data

US 2014/0158251 A1 Jun. 12, 2014

(30) Foreign Application Priority Data

Dec. 7, 2012 (EP) ..... 12008177

(51) Int. Cl.
*B65B 1/22* (2006.01)
*B65B 39/00* (2006.01)
(Continued)

(52) U.S. Cl.
CPC ..... *B65B 1/22* (2013.01); *B65B 1/24* (2013.01); *B65B 1/36* (2013.01); *B65B 39/007* (2013.01); *B65B 39/14* (2013.01)

(58) Field of Classification Search
CPC .. B65B 1/22; B65B 1/36; B65B 39/14; B65B 1/24; B65B 39/007
(Continued)

(56) References Cited

U.S. PATENT DOCUMENTS 225,940 A * 3/1880 McCrodden ..... B65B 1/22 141/235
244,378 A * 7/1881 Clark ..... B65B 39/00 141/237
(Continued)

FOREIGN PATENT DOCUMENTS

DE 102006010911 * 9/2007
JP 07109031 A * 4/1995
(Continued)

*Primary Examiner* — Allana Lewin Bidder
*Assistant Examiner* — James Hakomaki
(74) *Attorney, Agent, or Firm* — Gudrun E. Huckett

(57) ABSTRACT

A filling system for filling powder into a target container to be sealed has a metering device for metering a partial quantity of the powder to be filled in. A compaction element for the powder is arranged below the metering device. The compaction element can be lowered from above into the target container. The compaction element is a shaking element with a shaking drive. During filling of the target container with the powder, the shaking element at least partially projects from above into the target container. The shaking element has a bottom edge provided with a shaking projection, wherein the shaking projection, beginning at the bottom edge, extends downwardly. During filling of the target container with the powder, only the shaking projection of the shaking element projects from above into the target container and the shaking element as a whole does not contact the target container.

13 Claims, 3 Drawing Sheets

(51) Int. Cl.
*B65B 1/24* (2006.01)
*B65B 39/14* (2006.01)
*B65B 1/36* (2006.01)

(58) Field of Classification Search
USPC .... 141/71, 72, 73, 80, 78, 75, 12, 1, 11, 69, 141/280, 284, 364; 222/162, 161, 217, 222/221; 366/256, 104, 117, 335
See application file for complete search history.

(56) References Cited

U.S. PATENT DOCUMENTS 261,941 A * 8/1882 McCrodden ..... B65B 3/30 141/235
469,992 A * 3/1892 Cox ..... B65B 1/22 141/242
487,511 A * 12/1892 Blair ..... 366/342
1,932,385 A * 10/1933 Barthell ..... A23G 9/12 366/256
2,766,782 A 10/1956 Bell et al.
2,873,049 A 2/1959 Schafer et al.
3,012,697 A * 12/1961 Rouse, Jr. ..... A21C 9/04 209/236
3,146,997 A * 9/1964 McKinney ..... 366/110
3,702,147 A 11/1972 Slawinski
4,188,907 A * 2/1980 Lipani ..... 399/261
4,252,444 A * 2/1981 Herz ..... 366/117
4,475,671 A * 10/1984 McCorkel ..... B65G 65/44 198/533
4,630,755 A * 12/1986 Campbell ..... A01C 15/00 177/64
5,379,572 A * 1/1995 Giovannone ..... 53/478
5,779,390 A * 7/1998 Tuusinen ..... A63B 6/025 404/101
6,808,089 B2 * 10/2004 Hashimoto ..... B65B 1/06 141/1
7,174,694 B2 * 2/2007 Ogger et al. ..... 53/235
7,665,633 B2 * 2/2010 MacMichael ..... B65B 1/08 222/1
2004/0003866 A1 1/2004 Rocchio et al.
2004/0060265 A1 * 4/2004 Boeckle et al. ..... 53/476
2008/0257450 A1 10/2008 Combrink
2009/0200342 A1 * 8/2009 Albaum ..... 222/514
2010/0003158 A1 * 1/2010 Ando ..... B30B 11/022 419/66
2010/0126285 A1 * 5/2010 Caroll ..... B01L 3/0289 73/863.31
2010/0157721 A1 6/2010 Schmied et al.
2010/0212777 A1 * 8/2010 Weigel ..... 141/94
2011/0056585 A1 3/2011 Combrink
2012/0129748 A1 * 5/2012 Gordon et al. ..... C11D 17/042 510/224
2012/0132314 A1 * 5/2012 Weigel ..... B65B 1/36 141/2

FOREIGN PATENT DOCUMENTS

WO WO9308907 * 5/1993
WO 2005/014397 A1 2/2005
WO 2006/003377 A1 1/2006

* cited by examiner

FILLING SYSTEM FOR FILLING IN POWDER AND METHOD FOR FILLING IN POWDER

BACKGROUND OF THE INVENTION

The invention relates to a filling system for filling powder into a container to be sealed, comprising a metering device for metering a partial quantity of powder for filling, at least one compaction element for the powder, and at least one container, wherein, relative to the direction of gravity, the at least one compaction element is arranged below the metering device, wherein the at least one compaction element can be lowered from above into the container for the filling step, wherein the at least one compaction element is embodied as a shaking element with a shaking drive and wherein the shaking element at least partially projects from above into the container during the filling step. The invention also concerns a method for filling powder into a container to be sealed by means of the filling system.

Certain powders such as laundry detergents are produced as loose bulk material and are then metered by means of a metering device to predetermined partial quantities. The metered partial quantities are subsequently filled into a target container. Such target containers can be film packages of water-soluble film that contain an individual dosage of the powder for future use by the consumer. Such individually metered packages that are packaged in water-soluble film are designed to be placed into a washing machine. Upon contact with washing water, the film package dissolves and releases the predetermined quantity of laundry powder.

In such and in similar applications, it is important to keep the target container for receiving a certain metered quantity at a certain size that is not larger than necessary and to fill it to the brim. This is difficult to realize in practice. The metering device is usually positioned above the upwardly opened target container so that the metered quantity of powder, due to gravity (gravity feed), drops into the open target container to be sealed later on. As this happens, a loose conical heap of the bulk material is produced that may not surpass a certain height. Inasmuch as the height of the bulk material cone is kept low, the target container cannot be filled to the brim. When the bulk material cone is higher and projects upwardly past the plane of the sealing surface of the container, the subsequent sealing process is at risk. The bulk material cone is then an obstacle for application of the cover film that is to be sealed onto the container. Powder may come into contact with the sealing surface which impairs the quality of the seal to be produced. A complete utilization of the container volume is therefore not possible.

SUMMARY OF THE INVENTION

It is an object of the present invention to further develop a filling system of the aforementioned kind such that an improved filling level of the target container is enabled.

In accordance with the present invention, this is achieved in that in the filling system of the aforementioned kind at a bottom edge of the shaking element at least one shaking projection is formed that extends, beginning at the bottom edge, in downward direction and in that, during the filling process, as a part of the shaking element, only the at least one shaking projection which is formed below the bottom edge projects from above into the target container, wherein the shaking element as a whole does not contact the target container.

A further object of the invention is to provide a method for filling a powder into a target container wherein, by means of the method, the available container volume can be utilized better.

This object is solved in accordance with the invention by the following method steps:

metering the powder by means of the metering device and filling the powder in the direction of gravity from above into the open target container;

lowering the compaction element embodied as a shaking element from above onto the target container in such a way that, as a part of the shaking element, only the at least one shaking projection formed below the bottom edge is projecting from above into the target container, wherein the shaking element as a whole does not contact the target container;

causing the shaking element by means of its shaking drive to vibrate while the powder is filled in or subsequent thereto and compacting the powder and leveling its free surface by means of the compaction element, whereupon the filling process is completed.

According to the invention, it is provided that, relative to the direction of gravity, at least one compaction element for the powder is arranged below the metering device, wherein the compaction element for the filling process can be lowered from above in the direction of the target container. The compaction element is designed as a shaking element with a shaking drive wherein the shaking element during the filling process at least partially projects from above into the target container. At the bottom edge of the shaking element at least one shaking projection is formed which begins at the bottom edge and extends in downward direction. During the filling process, as a part of the shaking element, only the at least one shaking projection that is formed below the bottom edge is projecting from above into the target container, wherein the shaking element as a whole does not contact the target container.

In the corresponding method, the powder is metered first by means of the metering device and, in the direction of gravity, is filled from above (gravity feed) into the target container that is open in upward direction. The compaction element which is configured as a shaking element is lowered from above into the target container such that, as a part of the shaking element, only the at least one shaking projection that is formed below the bottom edge is projecting from above into the target container, wherein the shaking element as a whole does not contact the target container. As the powder is filled in or subsequent thereto, the shaking element is caused to vibrate by means of its shaking drive and compaction of the powder and leveling of its free surface by means of the compaction element is caused, whereupon the filling process is completed.

The advantages of the invention are in particular relevant in a filling system which comprises a transport chain for receiving and transporting the target containers. In such a transport chain which is embodied in particular as a plate chain, it is not possible, as a result of its damping properties, to cause the target containers to vibrate in order to achieve in this way compaction of the powder and leveling of the free surface. Instead, action on the powder is not provided at the container but from above by means of the compaction element which is arranged underneath the metering device and therefore is arranged during the filling process between the metering device and the target container. By means of the compaction element, either the formation of a cone of bulk material is prevented or such a cone, if present, is leveled. At the same time, compaction of the otherwise loosely filled-in powder is also achieved. A more uniform almost flat powder surface in the target container is obtained whose height level relative to the sealing surface of the upwardly open target container can be adjusted. In particular, it is possible to adjust the free powder surface at least approximately exactly to the same height level as the sealing surface. In connection with the simultaneous compaction of the powder, the container volume that is available can be utilized to the maximum while at the same time the sealing surface of the container can be kept free of any disruptive powder residues. Consequently, the ratio of the quantity of cost-intensive container material or packaging material to the predetermined metered powder quantity can be minimized.

The powder that is contained in the target container is subjected to vibrations without the container itself being vibrated. During the filling process, the formation of a bulk material cone is prevented. Alternatively, in a subsequent shaking process a possibly existing powder cone can be leveled to a flat free powder surface. In both cases, the shaking process leads to a compaction of the powder in the target container so that the available powder storage volume of the container can be optimally utilized.

It is preferred that at the bottom edge of the shaking element several shaking projections are formed which during the filling process project from above into the target container and into the powder bed that is contained therein, wherein a spacing remains between the shaking projections, respectively. Such a shaking projection is expediently embodied as a vertically oriented finger with a massive or solid cross-section but can also be of a deviating shape, for example, can be designed as a U-shaped bracket. This configuration as a finger with a solid cross-section has been found to be expedient in order to exert, on the one hand, an excellent compaction and leveling action; on the other hand, the shaking element subsequently can be pulled out upwardly from the powder volume without disturbing the achieved compaction and leveling action.

The shaking drive is preferably designed to cause a shaking movement of the shaking element in a horizontal lateral oscillation direction wherein the finger in cross-section has a thickness and a width, wherein the width in comparison to the thickness is greater. The finger is positioned with its greater width transversely to the oscillation direction. The greater width produces a large effective surface by means of which the oscillation power is introduced with high effectiveness into the powder while at the same time a small narrow cross-section of the at least one finger has the result that in the immersed state only little powder is displaced. The leveled surface and the compacted powder structure are only minimally disturbed upon removal of the finger or fingers.

In a further advantageous embodiment the target container has a sealing rim wherein the circumferential bottom edge of the compaction element in the lowered state is positioned approximately at the height level of the sealing rim or higher. Alternatively or in addition thereto a target filling level is provided for the target container wherein the circumferential bottom edge in the lowered state of the compaction element is positioned approximately at the height level of the target filling level or higher while at least a portion of the at least one shaking projection is positioned below the target filling level. In corresponding method steps, the compaction element for the compaction process is lowered so far that the aforementioned height or the aforementioned heights will result. In this way, it is ensured that only the shaking projection or the shaking projections of the compaction element can be immersed into the powder contained in the target container while the circumferential bottom edge is located above the powder surface during the entire filling process. The powder that is flowing into the target container can therefore be distributed uniformly and can form a uniform flat surface without being disturbed by the circumferential edge.

In an advantageous embodiment, a filling funnel is formed within the compaction element. In this way, it is ensured that filling, compaction, and surface leveling go hand in hand while at the same time the sealing surface of the target container can be kept free of powder. In particular, the filling funnel has a lower outlet opening wherein the bottom edge surrounds in a closed formation the outlet opening. The at least one shaking projection extends, beginning at the bottom edge, in such a way downwardly that the bottom edge forms laterally of at least one shaking projection at least sectionwise an exposed edge. The powder which is entering the target container can therefore not jam or accumulate in the area of the outlet opening. Instead, because of the exposed edges, gateways or windows are formed that enable a lateral distribution of the powder and thus a complete filling of the target container with at least approximately a flat surface at the target filling level.

In an expedient further embodiment, the filling system has a cover for the sealing rim of the target container. In this way, an additional safety measure is provided so that no powder can reach the sealing surface or the sealing rim as a result of the afore described compacting and leveling process.

Embodiments of the invention will be explained in the following with the aid of the drawings in more detail.

DESCRIPTION OF THE PREFERRED EMBODIMENTS

Figure 1:
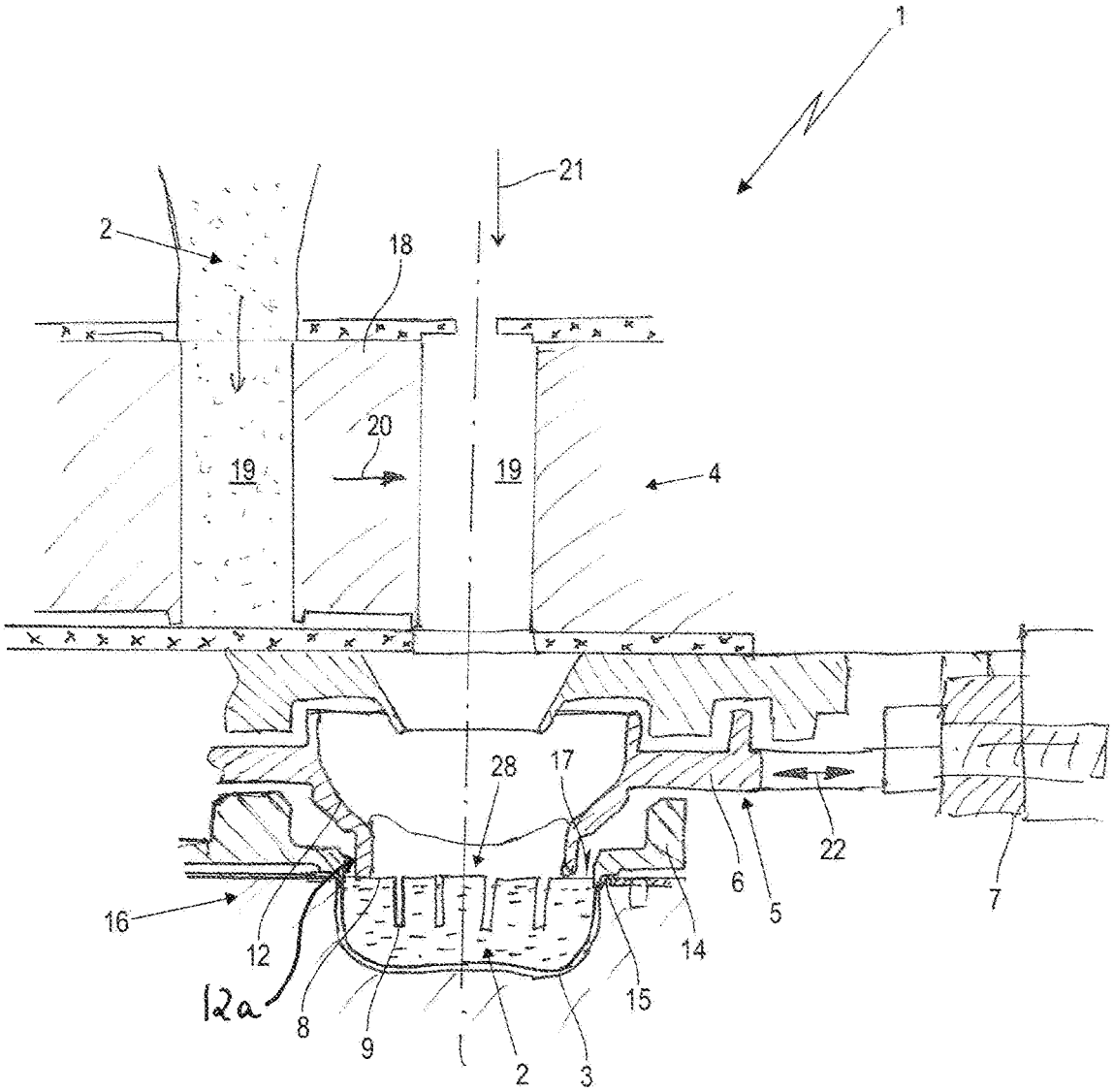
FIG. 1 is a schematic section illustration of a filling system according to the invention with a metering device and a compaction element that is formed as a shaking element.

FIG. 1 shows in a schematic section illustration a first embodiment of the filling system 1 according to the invention for filling powder 2 into a target container 3. The target container 3 is comprised advantageously of a bowl-shaped deep-drawn water-soluble film which later on, subsequent to the filling process, is to be sealed by a cover film, not illustrated. As an example, the powder 2 is a laundry detergent. Other kinds of powder and other target containers 3 can be employed also in connection with the invention.

The filling system 1 comprises a metering device 4, a compaction element 5 which, relative to the direction of gravity, is arranged underneath the metering device 4, a receptacle for the target container 3 to be sealed (in the illustrated embodiment, the receptacle is configured as a schematically indicated transport chain 16), a cover 14 as well as, during operation, also the target container 3. The transport chain 16 in the illustrated embodiment is embodied as a plate chain. For illustrating the invention, in FIG. 1 for reasons of simplification only one target container 3, a correlated compaction element 5, a correlated cover 14 as well as a correlated section of the metering device 4 with a metering bore 19 are illustrated. In practice, several target containers 3, arranged in a row or in a matrix, are filled simultaneously and each one has its own metering bore, its own cover 14, and its own compaction element 5. The compaction elements 5 can be combined to a common compaction plate. The same holds true also for the covers 14.

The filling system 1 is provided for filling powder 2 into the target container 3 that during filling is still open and is to be sealed later on. For this purpose, the powder 2 which is provided as loose bulk material in a storage container, not illustrated, is first metered by means of the metering device 4 to predetermined partial quantities. In the illustrated embodiment, the metering device 4 is a volumetric metering device with a metering slide 18 wherein in the metering slide 18 at least one metering bore 19, here several metering bores 19, are provided. The metering bores 19 have a fixed defined volume which corresponds to that of the desired metered volume of the powder 2. First, the metering slide 18 is positioned such that the metering bores 19 are positioned below the storage container for the powder 2 so that subsequently the powder drops into the metering bore 19. Subsequently, the metering slide 18 in accordance with arrow 20 is moved laterally so that a partial quantity of the powder 2 is metered within the metering bore 19 and so that this metered partial quantity is positioned above the target container 3 to be filled. In this context, the metered partial quantity of the powder 2 as a result of its weight (gravity feed) will drop from the bottom end of metering bore 19 into the target container 3, as illustrated in FIG. 1. In the target container 3 that is upwardly open and not yet sealed an upper free surface 17 of the powder 2 is thus formed.

For compacting the powder 2 which is contained in the still open target container 3 and for leveling the free surface 17, a compaction element 5 is provided which, relative to the direction of gravity, is below the metering device 4 and during filling is arranged between the metering device 4 and the target container 3 arranged underneath. In the embodiment according to FIG. 1, the compaction element 5 is formed as a shaking element 6 with a shaking drive 7. By means of the shaking drive 7 the shaking element 6 can be caused to vibrate or oscillate in accordance with double arrow 22 in horizontal and lateral direction. In the context of the invention, other vibration forms are however conceivable also.

The metering device 4, the compaction element 5, and a cover 14, which will be explained in the following in more detail, together form a modular unit which is correlated with an individual target container 3 to be filled. This modular unit of metering device 4, compaction element 5, and cover 14 is positioned within the machine as a whole, not illustrated in detail, at a stationary filling station while the target containers 3 by means of transport chain 16 are transported from station to station, i.e., in particular to the aforementioned filling station and also to a separate sealing station, not illustrated. In the illustrated embodiment, the transport chain 16 together with the target containers 3 secured thereon are moved continuously. The aforementioned "stationary positioning" of the filling station means in this context that the filling station, or its modular unit of metering device 4, compaction element 5, and cover 14, is moved only during the metering, filling, compaction, and leveling process synchronously with the transport chain 16 or the target containers 3 secured thereon and, subsequently, relative to the travel direction of the transport chain 16, is returned into its initial position. At this initial position, a new cycle of the metering, filling, compaction, and leveling process is then started with a new set of target containers 3. The filling station, or its disclosed parts, is thus not circulated continuously together with the transport chain 16 but only moves for a short travel distance that is required for the metering, filling, compaction and leveling process together the transport chain 16. However, it is also possible to provide a cycled sequence. In this context, the transport chain 16 together with the target containers 3 secured thereon are stopped at the individual stations, i.e., in particular at the filling station and the downstream sealing station so that at these stations the metering, filling, compaction and leveling process or the subsequent sealing process is carried out with the system elements at rest. The method according to the invention described herein can be analogously performed in the same way in continuous as well as in cycled operation of the transport chain 16.

With the filling, compaction, and leveling process according to the invention the target containers 3 are first positioned underneath the afore described metering and filling unit. The aforementioned unit including the compaction element 5 and the cover 14 is then lowered in accordance with arrow 21 from above onto the target container 3.

In the illustrated still open state, the target container 3 has an upwardly facing circumferential sealing rim 15 onto which later on a cover film is to be sealed. By the afore described lowering process, the cover 14 is placed onto the sealing rim 15 so that the sealing rim 15 is covered and cannot come into contact with the powder 2. Moreover, the cover 14 has a through opening which with regard to its contour corresponds to the upwardly open side of the target container 3 and therefore enables an unhindered entry of the powder 2 from above into the target container 3.

As a result of the described lowering action, the shaking element 6 also projects at least partially from above into the target container 3 such that an appropriate section of the shaking element 6 is positioned below the sealing rim 15 in the interior of the target container 3 as well as within the metered and filled-in powder quantity.

The filling process which is performed in this state of the filling system 1 is comprised of two partial processes which can be performed sequentially, simultaneously, or with temporal overlap. The first partial process is filling in the powder 2 through the compaction element 5 into the target container 3, as described above subsequent to the metering process. For assisting this partial process of filling, the compaction element 5 embodied as a shaking element 6 is formed with a filling funnel 12 comprising a circumferentially closed wall section 12*a* with a circumferentially extending bottom edge 8. The circumferentially closed wall section 12*a* of the filling funnel 12 has a lower outlet opening 28 which is delimited by the circumferentially extending bottom edge 8 surrounding in a closed configuration the outlet opening 28. Through the filling funnel 12 the powder 2 which is falling from above out of the metering bore 19 (gravity feed) is guided through the compaction element 5 in a targeted fashion into the target container 3. The second partial process of filling is comprised of compaction of the powder 2 contained in the target container 3 with formation of a more uniform, at least approximately planar free surface 17 by means of the compaction element 5.

For the second partial filling process, the compaction element 5 which is formed in the embodiment according to FIG. 1 as a shaking element 6 projects at least partially from above into the target container 3 and also into the powder 2 contained therein. It can be expedient to have the shaking element 6 or the filling funnel 12 project with the bottom edge 8 into the target container 3 or into the powder 2. In the illustrated embodiment, at the bottom edge 8 at least one and here several shaking projections 9 are formed which, in an exemplary fashion, are designed herein as vertically extending fingers with a solid cross-section. The shaking projections 9 extend, beginning at the bottom edge 8, in downward direction wherein between the neighboring shaking projections 9 a spacing is provided, respectively. In the illustrated embodiment, the upper modular unit is lowered to such an extent that the circumferential edge 8 of the filling funnel 12 is approximately located at the height level of the sealing rim 15 or higher while only the shaking projections 9 of the component of the shaking element 6, or as a part thereof, project into the target container 3. In this context, the shaking element 6 in its entirety does not contact the target container 3 and also not the mechanically adjoining components such as a holder of the target container 3, the link chain 16, or the cover 14.

First the powder 2 can be introduced into the target container 3 in the above described way while the shaking element 6 is at rest. In doing so, the filled-in powder 2 forms a bulk material cone of loosely layered powder. With a subsequent shaking process in which the shaking element 6 by means of the shaking drive 7 is caused to vibrate in accordance with arrow 22, vibration is generated that is transmitted by means of the shaking projections 9 onto the powder 2. Since otherwise no mechanical vibration-transmitting connection between the shaking element 6 and the target container 3 is existing, by means of the shaking projections 9 an exclusive direct and immediate introduction, without any detour, of the vibration energy into the powder 2 is realized. As a result of the introduced vibration energy the powder 2 is compacted while at the same time an at least approximately flat free surface 17 is formed. The free surface 17 rises during the filling process and during the optionally performed simultaneous shaking process to a target filling level as illustrated here, that is at least approximately at the same height level as the sealing rim 15 so that the target container can be filled to the brim. The illustration according to FIG. 1 also shows that the compaction element 5 for the compaction process must be lowered only to such an extent that its circumferentially extending bottom edge 8 is located approximately at the height level of the target filling level or higher. In this context, only a section of the shaking projections 9 is below the target filling level. In other words, only the lower sections of the shaking projections 9 project into the powder 2 so that, at least in the terminal phase of the shaking process with final formation of the flat free surface 17, the vibration energy is introduced into the powder 2 exclusively by the lower sections of the shaking projections 9.

Alternatively, the shaking drive 7 can also be switched on during the powder filling process from the metering device 4. In this case, a cone of bulk material produced in the way described above cannot even be formed. Instead, during the filling process a constant compaction of the powder 2 occurs and at the same time at least approximately a planar uniform free surface 17 is maintained until the target filling level is reached. Of course, in the context of the invention, also a temporally overlapping performance of both partial processes is possible and expedient so that first filling from the metering device 4 is started and then the shaking drive 7 with temporal delay, but still during the filling process, is activated. In any case, by compaction of the powder 2 in the target container 3 as well as by forming the more uniform free surface 17 it is achieved that the target container 3 at least approximately can be completely filled with powder 2 up to the height level of the sealing rim 15 without a partial quantity of the powder 2 projecting past the sealing rim 15 in a disturbing way and without the powder 2 contacting the sealing rim 15. Only subsequent to the afore described method steps the filling process is completed. The aforementioned at least approximate complete filling means that a leveled, more uniform free surface 17 of the compacted powder 2 that is almost precisely at the height level of the sealing rim 15 is desired, and this also means that this can even be realized. Relative to the aforementioned height level, this also means a slight underfilling for increasing the process safety or a slight overfilling upwardly past the sealing rim 15 inasmuch as thereby the subsequent sealing process is not impaired.

Subsequently, the afore described filling and compaction unit is lifted opposite to the direction of arrow 21 so that the shaking element 6 is lifted out of the powder 2 in upward direction. At the same time or with slight temporal delay, i.e., during the pulling out action or subsequent thereto, the cover 14 is also lifted off the sealing rim 15. Subsequent thereto, the target container 3, in particular by means of the transport chain 16, can be moved to the downstream sealing station. At this station, the subsequent sealing action of the target container 3, which is initially upwardly open and is now approximately filled to the brim, is carried out by sealing a cover material onto the sealing rim 15.

Figure 2:
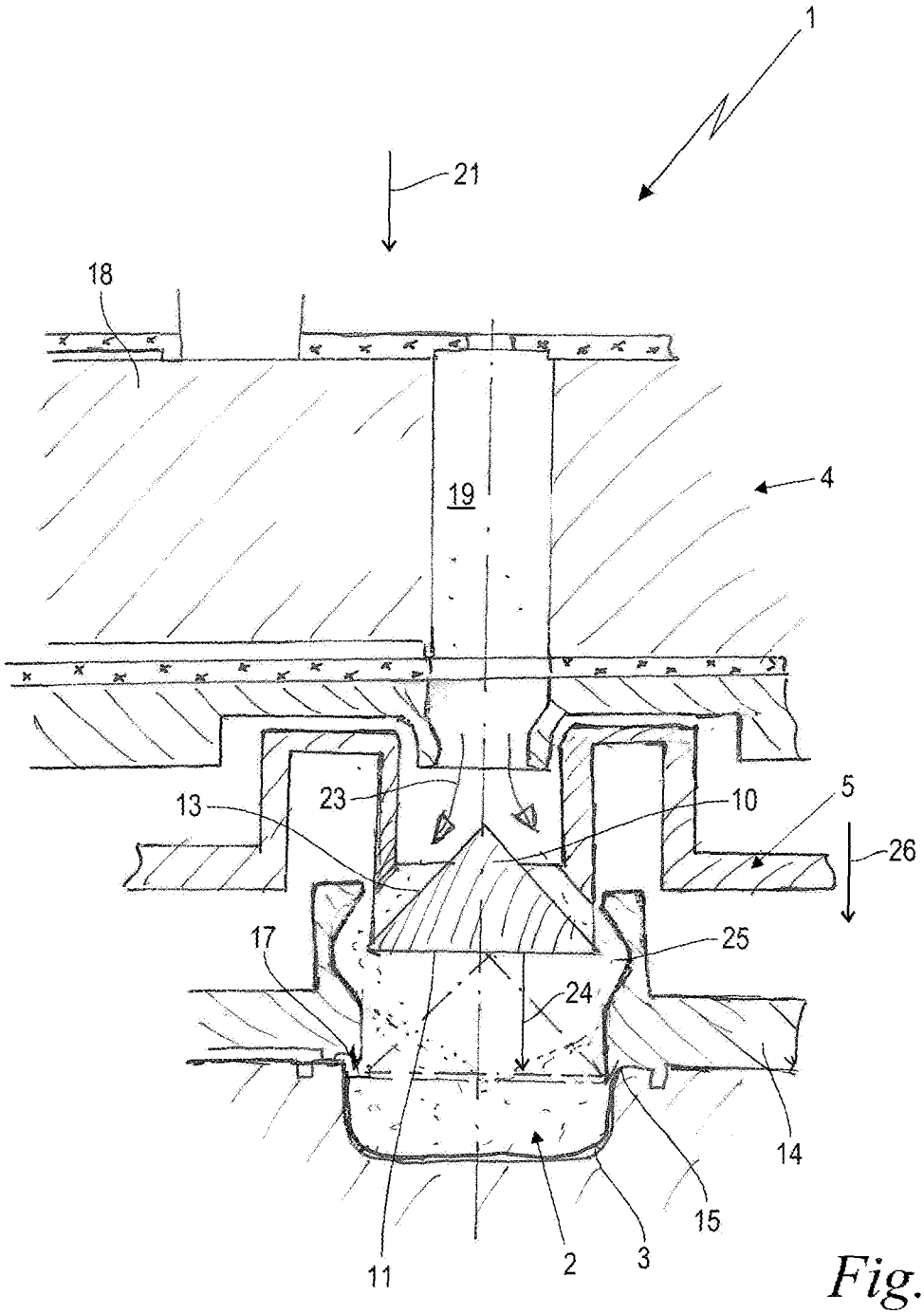
FIG. 2 is a variant of the arrangement according to FIG. 1 with a compaction element that is embodied as a pressing element.

FIG. 2 shows a variant of the filling system according to FIG. 1 wherein the compaction element 5 is a pressing element 10 with a pressing surface 11 that is facing the open side of the target container 3. In the compaction element 5, here above its pressing surface 11, a distribution surface 13 is formed. The distribution surface 13 can be in the form of individual slantedly positioned powder channels or the like; in the illustrated embodiment, it is conically shaped. The conical shape is arranged such that the tip of the cone is pointing upwardly to the metering bore 19 positioned above it. The conical part of the compaction element 5 on which the pressing surface 11 and the distribution surface 13 are formed is connected by webs with the remaining section of the compaction element 5. The cone shape of the distribution surface 13 is interrupted only at these webs and otherwise constitutes a complete cone. The powder flow flowing according to arrows 23 from the metering bore 19 is divided at the cone tip and guided along the conical wall surface such that it is guided annularly about the pressing surface 11 to the target container 3. This is assisted in that the cover 14 has a collar which surrounds the outer rim of the conical distribution surface 13. In the aforementioned collar an annular recess 25 is formed which, as a result of its rounded cross-sectional shape and despite the presence of the pressing surface 11, favors a powder introduction that is uniformly distributed across the base surface of the target container 3.

Relative to the metering device 4, the pressing element 10 is movable by means of a lifting device in vertical direction. In a correlated method step, after filling the powder 2 into the target container 3 the pressing element 10 with its pressing surface 11 is lowered in accordance with arrow 26 onto the free surface 17 of the powder 2 contained in the target container 3. As in the shaking process disclosed in connection with FIG. 1, in this way a compaction of the powder 2 and leveling of its free surface 17 is achieved as part of the filling process. After completed compaction and surface leveling, the pressing element 10 is then lifted opposite to the direction of arrow 26 and the filling process is then completed.

In regard to other features, reference numerals, and corresponding method steps, the embodiment according to FIG. 2 is the same as the embodiment according to FIG. 1. This includes also the optional but not mandatory possibility of providing in the embodiment according to FIG. 2 in addition to the lifting movement in accordance with arrow 26 also a shaking movement in accordance with the double arrow 22 of FIG. 1. In this case, the compaction element 5 according to FIG. 2 is simultaneously configured as a pressing element 10 and also as a shaking element 6 and, in accordance with the illustration of FIG. 1, is optionally also provided with one or several shaking projections 9.

Figure 3:
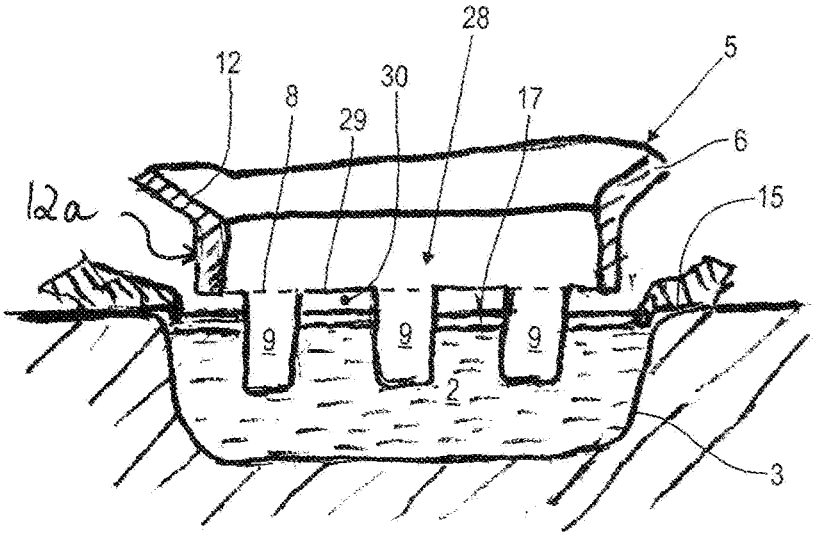
FIG. 3 is a schematic detail illustration of the arrangement according to FIG. 1 in the area of the shaking element with shaking projections immersed into the powder and the free edge of the filling funnel arranged above.

FIG. 3 shows in a schematic detail illustration the arrangement of FIG. 1 in the area of the shaking element 6 with shaking projections 9 immersed into the powder 2 wherein same features are identified with same reference characters. In comparison to the illustration of FIG. 1, the arrangement is shown rotated about the vertical axis by 90° so that the oscillation orientation of the illustration of FIG. 1 indicated by arrow 22 is perpendicular to the drawing plane of FIG. 3. The free surface 17 corresponds also to the target filling level. In the detail illustration according to FIG. 3, it can be seen that the bottom edge 8 forms, laterally from at least one shaking projection 9, here between the neighboring shaking projections 9 that are spaced from each other, at least sectionwise a free exposed edge 29. The three exposed edges 29 are positioned, like the circumferential bottom edge 8, as a whole above the sealing rim 15 and above the target filling level. In other words, the shaking projections 9, beginning at the lower edge 8 or beginning at the sectionwise free exposed edges 29, have in vertical direction, more precisely in the lowering direction indicated by arrow 21 (FIG. 1) a given length and do not projecting with their total length into the powder 2. Relative the free surface 17 which is formed at the target filling level or relative to the level of the sealing rim 15, the shaking projections 9 project with, as a lower limit, at least one fourth of their length, preferably at least one third of their length, and in particular with at least one half of their length, into the powder. However, there is also a preferred maximum immersion depth wherein the shaking projections with maximally three fourths of their length are immersed in the powder 2. In the illustrated preferred embodiment, the shaking projections 9 project with approximately ⅔ of their length into the powder. In this way, and due to the free exposed edges 29 and the adjoining shaking projections 9, windows 30 are formed which project in upward direction past the free surface 17 or past the sealing rim 15 and through which the powder, entering from above and coming from the filling funnel 12 and flowing through the outlet opening 28, can pass laterally between the shaking projections 9 into the target container. The shaking element 6 with its circumferentially extending bottom edge 8 including the free exposed edges 29 as well as the windows 30 is illustrated additionally also in FIG. 4. A powder jam in the area of the filling funnel 12 or the outlet opening 28 can be avoided reliably. Instead, the powder 2 can flow unhindered and uniformly in lateral direction and can fill the target container 3 completely.

Figure 4:
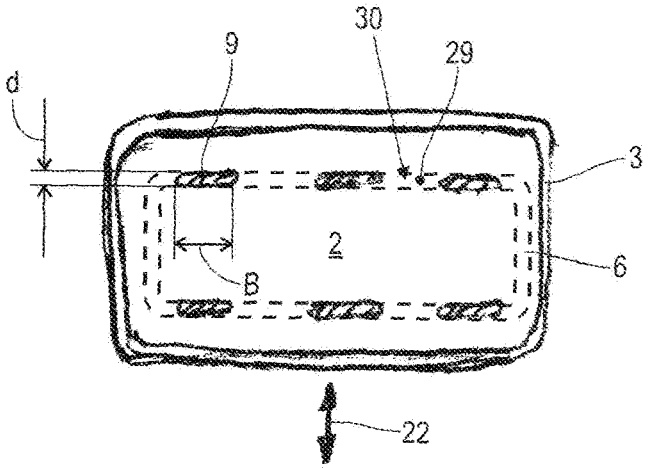
FIG. 4 is a schematic plan view of the arrangement according to FIG. 3 with shaking projections that in cross-section are solid and have a rectangular shape and that extend such that their greater width is transverse to the oscillation direction.

FIG. 4 shows in a schematic plan view the arrangement of FIG. 3 with shaking projections 9 that have a solid cross-section. As already disclosed in connection with FIG. 1, the illustrated shaking drive 7 is designed for a shaking movement of the shaking element 6 in a horizontal lateral oscillation direction 22. The fingers or shaking projections 9 have in the solid cross-section according to FIG. 4 a thickness d and a width B that in comparison to thickness d is greater. In this connection, as an example a rectangular cross-section is selected; however, a deviating cross-sectional shape is conceivable also. The fingers or shaking projections 9 are positioned with their greater width B transversely to the oscillation direction 22. Transversely positioned does not necessarily mean in the context of the invention that the direction of the greater width B is positioned 90° relative to the oscillation direction 22. Positioned transversely means in the context of the invention also angles that deviate from 90° inasmuch as the effective width projected in the direction of the oscillation direction 22 is greater than the effective thickness projected perpendicularly to the oscillation direction 22. Based on the length and the actual width B or the projected effective width, despite comparatively minimal cross-sectional surfaces, large effective lateral surfaces of the fingers or shaking projections 9 are provided by means of which the vibration energy can be introduced from the shaking element 6 into the powder 2 that is contained in the target container 3.

The specification incorporates by reference the entire disclosure of European priority document 12 008 177.3 having a filing date of Dec. 7, 2012.

While specific embodiments of the invention have been shown and described in detail to illustrate the inventive principles, it will be understood that the invention may be embodied otherwise without departing from such principles.

What is claimed is:

1. A filling system for filling powder into a target container to be sealed, the filling system comprising:

a metering device for metering a partial quantity of the powder to be filled into the target container;

a compaction element arranged below the metering device in the direction of gravity;

wherein the compaction element is configured to be lowered from above, in the direction of gravity, into the target container into a lowered state;

wherein the compaction element is comprised of a filling funnel and a shaking drive operatively connected to the filling funnel;

wherein, during filling of the target container with the powder, the filling funnel at least partially projects from above, in the direction of gravity, into the target container;

wherein the filling funnel comprises a circumferentially closed wall section provided with a lower outlet opening, wherein the circumferentially closed wall section has a bottom edge surrounding the lower outlet opening in a closed configuration, and wherein the bottom edge is provided with one or more shaking projections that begin at the bottom edge and extend downwardly;

wherein the filling system is configured such that, during filling of the target container with the powder, only the one or more shaking projections of the filling funnel project from above into the target container and, during or after filling, the shaking drive oscillates the filling funnel and the one or more shaking projections projecting from above into the target container and the oscillating one or more shaking projections act on and compact the powder in the target container;

wherein the filling funnel does not contact the target container.

2. The filling system according to claim 1, wherein the shaking projections that project from above into the target container during filling of the target container with the powder have a spacing between them, respectively.

3. The filling system according to claim 1, wherein the one or more shaking projections each are a vertically oriented finger with a solid cross-section.

4. The filling system according to claim 3, wherein the shaking drive is configured to carry out a shaking movement for shaking the filling funnel in a horizontal lateral oscillation direction, wherein the finger in cross-section has a thickness and a width, wherein the width in comparison to the thickness is greater, and wherein the finger is positioned such that the width is transverse to the oscillation direction.

5. The filling system according to claim 1, wherein the target container has a sealing rim and wherein the bottom edge is a circumferential edge and, in the lowered state of the compaction element, the bottom edge is positioned approximately at a level of the sealing rim or higher than the sealing rim.

6. The filling system according to claim 1, wherein the target container has a target filling level and wherein the bottom edge is a circumferential edge that, in the lowered state of the compaction element, is positioned approximately at the level of the target filling level or higher than the target filling level while at least a section of the one or more shaking projections is located below the target filling level.

7. The filling system according to claim 1, wherein the shaking projections extend downwardly such that the bottom edge, at least sectionwise, forms a free edge laterally relative to the shaking projections.

8. The filling system according to claim 1, wherein the target container has a sealing rim and wherein the filling system has a cover for the sealing rim of the target container.

9. The filling system according to claim 1, comprising a transport chain configured to receive and transport the target container.

10. A method for filling powder into a target container to be sealed with a filling system according to claim 1, the method comprising the steps of:

metering the powder with a metering device to a metered powder quantity and filling the metered powder quantity in the direction of gravity from above into the open target container;

lowering a compaction element of the filling system that is comprised of a filling funnel and a shaking drive operatively connected to the filling funnel, the filling funnel comprising a circumferentially closed wall section provided with a lower outlet opening, the circumferentially closed wall section comprising a bottom edge surrounding the lower outlet opening in a closed configuration, and the bottom edge provided with one or more shaking projections that begin at the bottom edge and extend downwardly, from above in the direction of gravity onto the target container such that only the one or more shaking projections are projecting from above into the target container and the filling funnel does not contact the target container;

oscillating the filling funnel and the one or more shaking projections by the shaking drive operatively connected to the filling funnel during filling of the metered powder quantity into the target container, or subsequently to filling, and acting on and compacting the metered powder quantity in the target container and leveling a free surface of the metered powder quantity by the oscillating one or more shaking projections to thereby complete filling of the target container.

11. The method according to claim 10, wherein the compaction element is lowered such that the bottom edge is approximately positioned at the level of a sealing rim of the target container or higher than the sealing rim.

12. The method according to claim 10, wherein the compaction element is lowered to such an extent that the bottom edge is approximately at a target filling level of the target container or higher than the target filling level and wherein at least a section of the one or more shaking projections is positioned below the target filling level.

13. The method according to claim 10, wherein the shaking drive causes the shaking element to carry out a shaking movement in a horizontal lateral oscillation direction, wherein the one or more shaking projections are formed as a finger with a solid cross-section and having in cross-section a thickness and a width, wherein the width in comparison to the thickness is greater, and wherein the finger is positioned such that the width is transverse to the oscillation direction.

* * * * *